CONNECTING DEVICE FOR STIFF ELECTRIC CONDUCTORS

This application is a continuation of my application Ser. No. 586,936 filed Mar. 7, 1984 and now abandoned.

BACKGROUND OF THE INVENTION

1. Field of Invention

The present invention relates to an improved electrical busway structure which contains a novel device for connecting busway members. The device may be used to connect two or more stiff bar conductors or buses or may be used to connect conductors with wire terminals to stiff bus bar conductors.

2. Description of the Prior Art

It is known in the prior art that various conductor assemblies are available to the electrical industry. In fact, the busway system has been widely employed as the preferred method for distributing electrical loads. The busway system is a versatile, flexible, and economical wiring system. These systems or structures are made up, usually, of copper or aluminum bus bars mounted on insulators within a steel housing. The busways are normally factory-assembled and are supplied in standard or "stiff" 10-foot sections. If longer runs of bars are needed, several standard sections would be fastened together by plug devices of the prior art, such as those shown in Italian Pat. No. 48370 A/77. It has been found that the busway structure is superior to armor cable conductors for long, straight runs of conductors and is cheaper for service above 1000 amperes.

SUMMARY OF THE INVENTION

The busway structure of the present invention is applicable to a wide range of uses but is particularly useful in a load-center substation. As those in the industry know well, the location and number of substations for a given source distribution system depend on the layout of the building, the capacity of the individual stations, and the total load to be served. Actually, the use of load-center substations allows efficient and economical distribution of large amounts of power throughout a given industrial plant. Distributing power at high voltages requires much lower feeder current-carrying capacity than would be required to distribute the same amount of power at low voltage. As a result, the stiff bus bar conductor is widely used in substation work. Connections are required between bus members themselves for long runs, between the ends or sections of stiff members and armored cables having wire terminals for secondary feeders or branch circuits, and between transformers and bus members; other connection possibilities will be readily apparent to those skilled in the art.

Many substations are designed as being radial selective for overload protection. For example, a primary-selective radial electrical distribution system sets up a choice of primary feeders for improved service reliability in the event of a primary feeder fault. Transfer switching requiring connections of the type of the present invention is provided to switch over to other primary feeders. Transformers are connected to a common secondary bus and divide the load between them. Each transformer feeds the secondary through a network protector. Upon primary feeder or transformer failure, the secondary is isolated from the defective portions by the automatic operation of the network protector of the type known to those skilled in the art.

In all cases, feeder bus conductors of the types described must be properly selected for a given application. Feeder bus bars must be able to carry the amount of current required by the load plus an allowance for growth. The electrical system design, which does properly select the feeder conductors, evaluates such factors as demand factor, diversity factor, and load factor. The demand factor is the ratio of maximum demand to the total connected load. This factor will be less than 1.0. Diversity factor is the ratio of the sum of the individual maximum demands to the total maximum demand and may vary between 1.0 and 2.0. Load factor is the ratio of the average load in a given time to the peak load at that time and will be less than 1.0. In the selection of feeder conductors, those skilled in the art have developed tables of these factors. However, it is common and preferred practice to assume that the diversity factor in main feed conductors to load-center substations be 1.0 to provide spare feeder capacity.

Sizing of conductors whether bus or armored cables depends on service factors. The criteria for sizing conductors is based on the foregoing description and is well known in the art. However, there are some special requirements that must be adhered to for the design of substations. For example, transformers used indoors in primary service of over 15,000 volts must be installed in a self-contained vault. If the transformer is rated less than 15,000 volts on the primary coil and contains a liquid that will not burn and is otherwise mechanically protected, it need not be installed in a vault. Primary switches, circuit breakers, and other control apparatus, as well as transformers, need connection to each other by the device of the present invention to complete an integrated electrical system design. These apparatus need not be installed in a vault if each is built and approved for use outside a vault.

Similarly, special consideration may need to be given to the installation environment of the conductor itself. In many electrical installations the use of exposed bus bars or flat, stiff conductors must be avoided. For example, there are requirements that bus bars used in metal-clad switch gear be covered with insulation. This also means that the supports for the busway structure also be insulated. Care must be taken to provide sufficient connection of the bus bar member to equipment or apparatus without exposing any bare bus. Insulation may be provided by a dipping or coating procedure.

The invention provides a busway structure which contains a device for connecting insulated bus bars. The device has a T-shaped bushing inserted through apertures in busway members to be connected. The T-shaped bushing has a threaded bore into which is screwed a mating bolt from the opposite direction. The bolt head rests on an O-ring cap so that tightening the bolt forces the O-ring cap against the outer surface of one bus member and forces the head of the T-shaped bushing against the outer surface of the other bar member for firm engagement therebetween of the bus bar members. Preferably, the T-shaped bushing extends through all bus members being connected and into the interior chamber of the O-ring cap.

One object of the present invention is to provide a busway structure comprising at least two insulated bus members; aperture means aligned through the bus members; T-shaped bushing means having an axial threaded bore and extending the axial length of the aperture means; O-ring cap means placed axially with respect to the bore in the bushing means; and, bolting member positioned through the O-ring means with the head of the bolting member in contact with the top surface of the O-ring cap and fastened into the mating threaded bore such that tightening the bolting member will urge the O-ring cap means towards the T-shaped bushing means for firm engagement therebetween of the busway members.

Another object of the present invention is to provide an improved busway structure in which the O-ring cap means has an integral radially outwardly projecting rim on the top surface thereof sufficient to form a cavity to accept the head of the bolting member.

Still another object of the present invention is to provide an improved busway structure further comprising cover means fastened to said rim whereby the O-ring cap means and the bolting member are enclosed within the cover means.

A further object of the present invention is to provide an improved busway structure whereby the T-shaped bushing means has an appendage extending into the interior chamber of the O-ring cap means.

A still further object of the present invention is to provide an improved busway structure wherein said bushing means and O-ring cap means are electrically conductive.

BRIEF DESCRIPTION OF THE DRAWINGS

These as well as other objects of the present invention will become apparent from the following descriptions of the accompanying drawings in which.

DESCRIPTION OF THE PREFERRED EMBODIMENTS

Figure 1:
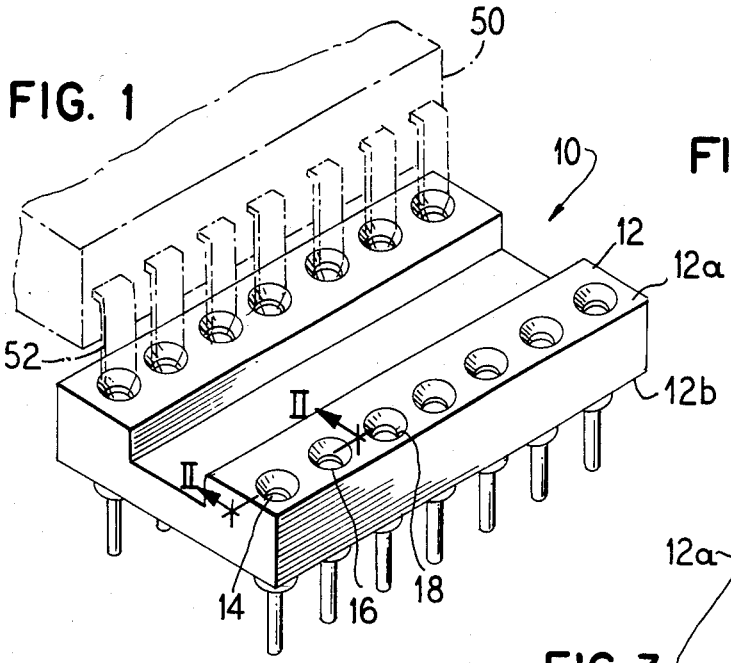
FIG. 1 is a cut-away perspective view of a busway structure connected together in accordance with the teachings of the present invention.
Figure 5:
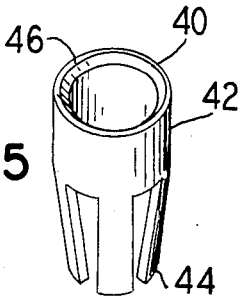
Figure 3:
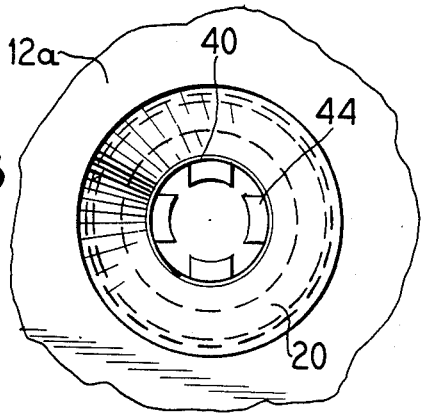

Referring to FIG. 1, bus members 1 and 12 are to be connected pursuant to the teachings of the present invention. Both members may be insulated 20 by dipping or coating if required by the standards of the electrical industry for the installation in question. The bar members are made of copper or aluminum but may be of other electrically conductive materials. It is contemplated by the present invention that one bus member is a flat or stiff bus bar and the other member be a flat or stiff bus bar or armored cable having wire terminals.

A bushing 2, having a T-shaped unit with a head 7, is inserted into aperture 6. Bushing 2 also has bore 11 which is threaded in conventional manner. Bushing 2 extends through bus members 1 and 12. Placed in an axial position to the aperture 6 is O-ring cap 3 which has rim 10 facing outwardly. O-ring cap 3 has a chamber 14 into which extends an appendage 13 of bushing 2. Bushing 2 and its appendage 13 preferably, should fill chamber 14 but should not completely touch the top of the interior chamber. Otherwise, there could be a restraint against full firm engagement of the bus members being connected. A bolting member 4 is screwed into bore 11 which has mating threads. The head 16 of bolt 4 rests within the rim cavity 15.

Cover 5 may be fastened to O-ring 3 by screw means, not shown, sufficient to cover and therefore insulate bolt 4 and O-ring 3. Cover 5 may be made of appropriate insulating material such as plastic, e.g. polyvinyl chloride (PVC).

In practice, before attaching cover 5, bolt 4 is tightened. Such tightening action forces the lower radial edge 8 of the O-ring against one bus 1 and simultaneously forces the head 7 of bushing 2 against the other bus member 12, thereby creating a solid electrical connection therebetween. Cover 5 is then attached as previously discussed.

O-ring 3 and bushing 2, preferably, are made of electrically conductive material, such as copper or aluminum. Similarly, bolt 4 may be electrically conductive, e.g. copper or aluminum to match the materials of O-ring 3 in bushing 2.

Figure 2:
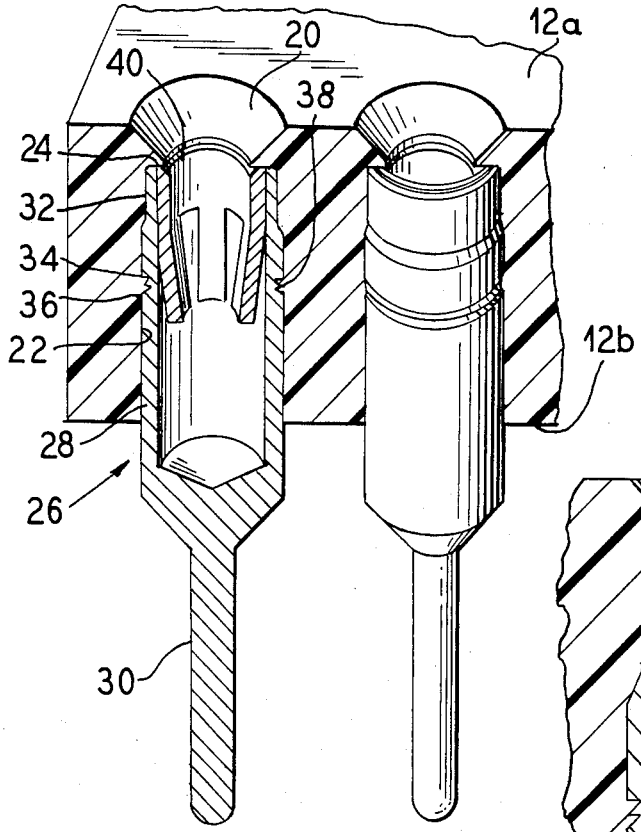
FIG. 2 is a top plan view of the structure shown in FIG. 1.
Figure 4:
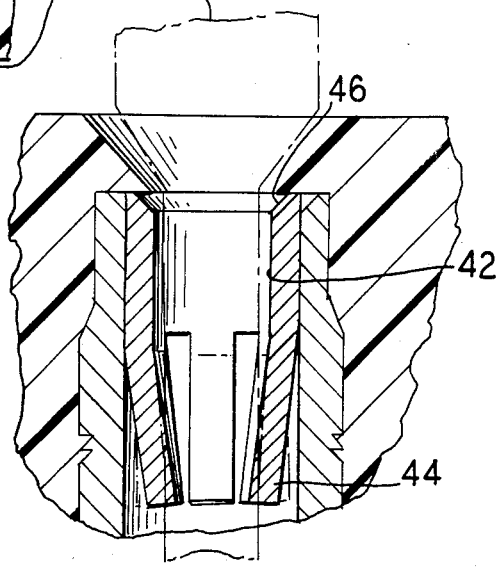
Figure 1:
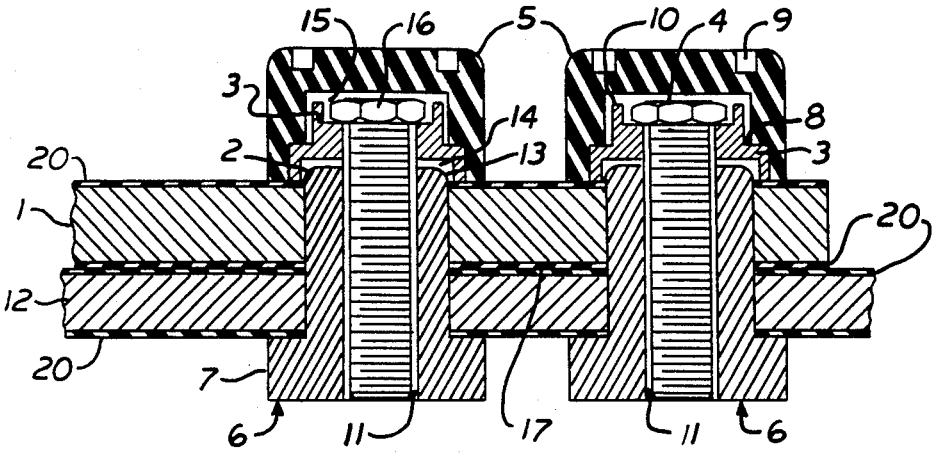
Figure 2:
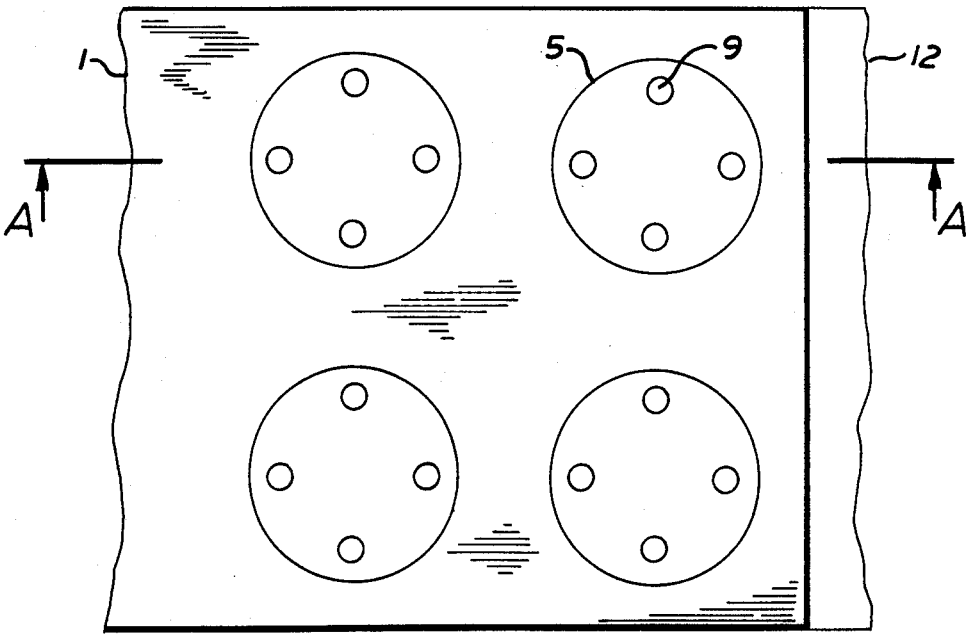

Referring specifically to FIG. 2, at least four apertures covered by cover 5 are drilled in bus members 1 and 12 although more than four may be needed for strength purposes. In some applications, only two apertures may be needed. Alternately, holes 9 may be drilled in cover 5 so that fastening of the cover may be made by inserting screw means (not shown) into holes 9 through the body of cover 5 into the O-ring cap sufficient for cover 5 to enclose both O-ring cap and bolt head 16 of bolt 4.

It is evident from the foregoing description of the present invention, that bus member 12 may be a flat bus bar or the wire terminal from armored cable or any other connector which is to be used for a connection to bus bar member 1. Also, it is within the scope of the present invention that the area of contact 17 immediately adjacent to the area encompassing the apertures may be insulated, thereby providing intimate and secure electrical contact between the bar member structure. Alternatively, after completion of the connection to exposed uninsulated areas, e.g. the head 7 of bushing 2, may be sprayed within insulating material.

In the foregoing description, the present invention has been described with a preferred illustrative embodiment. It is to be understood that the invention is not limited to this precise structure, and that changes may be made therein without departing from the scope of the invention.

I claim:

1. Busway structure comprising:

(a) at least two insulated bus members contacting each other from separate parallel planes;

(b) an aperture aligned through the bus members;

(c) a T-shaped bushing having an axial threaded bore and extending the length of the aperture;

(d) an O-ring cap placed axially with respect to the aperture and with respect to the bore in the bushing;

(e) a bolt positioned through the bushing with an integral head of the bolt in contact with a top surface of the O-ring cap and the remainder of the bolt mating with the threaded bore such that tightening the bolt will urge the O-ring cap toward the T-shaped bushing for firm engagement therebetween of the busing members and (f) the top surface of the O-ring cap having an integral axially downward projecting rim sufficient to form a cavity to accept the head of the bolt and a bottom surface of the O-ring cap forming a U-shaped chamber for accepting an appendage from the T-shaped bushing.

2. Busway structure according to claim 1 further comprising a cover fastened to said rim whereby the O-ring cap and the bolt are enclosed within the cover.

3. Busway structure according to claim 1 wherein said bushing and O-ring cap are electrically conductive.

* * * * *